US005839885A

United States Patent [19]

Oda et al.

[11] Patent Number: 5,839,885

[45] Date of Patent: Nov. 24, 1998

[54] CAPACITY CONTROL APPARATUS FOR A VARIABLE CAPACITY HYDRAULIC PUMP

[75] Inventors: Yosuke Oda; Kenji Morino; Naoki Ishizaki, all of Tochigi, Japan

[73] Assignee: Komatsu Ltd., Tokyo, Japan

[21] Appl. No.: 776,526

[22] PCT Filed: Sep. 14, 1995

[86] PCT No.: PCT/JP95/01839

§ 371 Date: Feb. 27, 1997

§ 102(e) Date: Feb. 27, 1997

[87] PCT Pub. No.: WO96/08652

PCT Pub. Date: Mar. 21, 1996

[30] Foreign Application Priority Data

Sep. 14, 1994 [JP] Japan ..... 6-219921

[51] Int. Cl.[6] ..... F04B 49/00

[52] U.S. Cl. ..... 417/213; 417/222.1; 60/445

[58] Field of Search ..... 417/213, 218, 417/222.1; 60/443, 444, 445

[56] References Cited

U.S. PATENT DOCUMENTS 4,710,106 12/1987 Iwata et al. ..... 417/213
4,976,106 12/1990 Noerskau et al. ..... 60/445
5,344,288 9/1994 Oda ..... 417/222.1

FOREIGN PATENT DOCUMENTS 4-62378 5/1992 Japan .
4-137285 12/1992 Japan .

*Primary Examiner*—Charles G. Freay
*Attorney, Agent, or Firm*—Nikaido, Marmelstein, Murray & Oram LLP

[57] ABSTRACT

A capacity control apparatus for a variable capacity hydraulic pump including: a capacity control cylinder having a capacity control piston for driving a capacity control member of the hydraulic pump, with a large diameter chamber and a small diameter chamber disposed at both sides of the capacity control piston, and driving the capacity control piston with a pressure fluid that is supplied into the larger diameter chamber, in a direction in which the capacity of the hydraulic pump may be reduced and for driving the capacity control piston with a pressure fluid that is supplied into the small diameter chamber, in a direction in which the capacity may be increased; a passage for the small diameter chamber to communicate with a pump discharge path; at least one control valve for controlling the capacity of the hydraulic pump by selectively communicating the large diameter chamber with either a pump pressure discharge path and a reservoir; and a variable throttle valve in a passage with the at least one control valve, in which the variable throttle valve is switched into a first state in which a throttled area of aperture in inverse proportion to a self discharge pressure of the pump discharge path is established and into a second state in which a predetermined throttled area of aperture that is independent of the self discharge pressure is established in response to an external signal.

13 Claims, 10 Drawing Sheets

CAPACITY CONTROL APPARATUS FOR A VARIABLE CAPACITY HYDRAULIC PUMP

TECHNICAL FIELD

The present invention relates to an apparatus for controlling the capacity of a variable capacity hydraulic pump, that can be used in a hydraulic circuit for a working machine actuator of a hydraulic shovel or the like.

BACKGROUND ART

As an apparatus for controlling the capacity (i. e. the amount of discharge per rotation) of a variable capacity hydraulic pump (hereinafter simply referred to as a variable hydraulic pump), there has hitherto be known an apparatus that is designed to maintain the driving torque (i. e. the capacity x the pump discharge pressure) constant by controlling the capacity in accordance with the pump discharge pressure.

On the other hand, as a hydraulic circuit for a working machine actuator in a construction machine such as a power shovel, there has been known a hydraulic circuit of pressure compensation type in which the discharge pressure fluid of a single variable hydraulic pump is supplied via a plurality of operating valves into a like plurality of actuators, there is provided a pressure compensating valve and, with this pressure compensating valve set according to a highest load pressure, the discharge pressure fluid of the single variable hydraulic pump is supplied, distributively in terms of the flow rates of the fluid, simultaneously to the actuators of different loads.

In such a hydraulic circuit of pressure compensation type, the capacity of a variable hydraulic pump is so controlled according to different load pressures that for a low load pressure the capacity may be decreased to lower the pump discharge pressure and then to reduced the energy loss and for a high load pressure the capacity may be increased to heighten the pump discharge pressure.

For the known apparatus, as mentioned above, for controlling the capacity so as to maintain the driving torque constant and at the same time so as to maintain a differential pressure between the pump discharge pressure and the load pressure constant, one that is illustrated in FIG. 1 of the accompanying drawings hereof will be typical.

More specifically, in a hydraulic circuit in which the discharge path 2 of a variable capacity hydraulic pump 1 (hereinafter referred to as a variably hydraulic pump) is connected via an operating valve 3 to an actuator 4, there is provided a capacity control cylinder device 6 in which a capacity control member, e. g., a swash plate 5, of the variable hydraulic pump 1 is operated to increase and decrease the capacity and which has a large diameter chamber 7, a small diameter chamber 10 and a capacity control piston 6*a* that is displaced by a differential pressure between the said two chambers, and the pump discharge pressure is supplied from a pump pressure introduction passage 14 into a large diameter chamber 7 controlledly via a first control valve 8 and a second control valve 9 and is also supplied directly into the said small diameter chamber 10 from the said pump pressure introduction passage 14.

The above mentioned first control valve 8 is adapted to be thrusted towards a supply position A under a pressure within a pressure receiving section 11 and to be thrusted towards a drain position B by a spring 12 that is provided at the opposite side to the said pressure receiving section 11. The said pressure receiving section 11 is configured to communicate with the said pump pressure introduction passage 14 via a first fluid passage 13. The said spring 12 is held in contact with a feedback lever 15. And, the said first control valve 8 at its position A is adapted to deliver the pump discharge pressure from an inlet port 16 to an outlet port 17 and at its position B is configured to establish a communication of the said outlet port 17 with a tank port 18 and also to block the said inlet port 16.

The said second control valve 9 is adapted to be thrusted towards a first position C under a pressure within a first pressure receiving section 19 and to be thrusted towards a second position D under a pressure within a second pressure receiving section 20 that is provided at the opposite side to the said first pressure receiving section 19. And, the said first pressure receiving section 19 is configured to communicate with a pump pressure introduction passage 14 via a second fluid passage 21 and the said second pressure receiving section 20 is configured to communicate with a load pressure port 23 via a third fluid passage 22. Also, an inlet port 24 of the said second control valve 9 is provided that is configured to communicate with the above mentioned pump pressure introduction passage 14 via a fourth fluid passage 25. A first port 26 is provided that is configured to communicate with the outlet port 17 of the said first control valve 8 via a fifth fluid passage 27. A second port 28 is provided that is adapted to communicate with the above mentioned large diameter chamber 7 of the said capacity control valve 6 via a sixth fluid passage 29.

An explanation will next be given with respect to an operation for controlling the capacity, i. e. the amount of fluid discharge per rotation, of the said variable hydraulic pump 1 by rotationally inclining the said swash plate 5.

If the pump discharge pressure $P_1$ of the said variable hydraulic pump 1 is first increased, the said first control valve 8 will take the said supply position A to allow the pump discharge pressure to be applied to the said large diameter chamber 7 via the said second control valve 9. Then, a difference in pressure receiving area between the said large diameter chamber 7 and the said small chamber 10 will cause the said capacity control piston 6*a* to be thrusted rightwards to swing the said swash plate 5 in a manner to reduce its angle of inclination, thus to reduce the capacity of the said variable hydraulic pump 1.

Also, since the feedback lever 15 is displaced rightwards to increase the set load of the said spring at the same time, the said first control valve 8 will be thrusted to assume the said drain position B, thereby lowering a pressure that is applied to the said large diameter chamber 7 of the capacity control cylinder device 6 whereas the said capacity control piston 6*a* will be returned leftwards to rotationally increase the angle of inclination of the said swash plate 5, thus increasing the said capacity.

It should be noted that the foregoing operation will render the amount of discharge for a single rotation of the said variable capacity hydraulic pump 1 commensurate with the pump discharge pressure $P_1$.

In other words, the driving torque of the said variable hydraulic pump 1 will be maintained constant with the said first control valve 8, the said capacity control cylinder device 6 and the said feedback lever 15 changing the capacity of the said variable hydraulic pump 1 according to its own pump discharge pressure.

Also, with respect to the said second control valve 9, it should be noted that when the load pressure $P_o$ is made equal to the pump discharge pressure, or when their difference in pressure is smaller than a difference between the established load pressure $P_o$ and the the pump discharge pressure, that is, if a difference in pressure around the meter-in of the said operating valve 3 is small, if the area of aperture of the above mentioned operating valve 3 is large, and when a required flow rate of the said operating valve 3 is greater than the pump discharge flow rate, the said second control valve 9 will assume the said second position D to allow the pressure fluid to flow out of the said large diameter chamber 7 of the capacity control cylinder device 6 into the reservoir to swing the said swash plate 5 in a sense to increase its angle of inclination, thus in a sense to increase the capacity of the said variable hydraulic pump 1. Then, its discharge flow rate (capacity) will thereby be increased. It should also be noted that when the required flow rate of the said operating valve 3 is smaller than the pump discharge flow rate, the said second operating valve 9 will assume its first position C in opposition to the above to reduce the pump discharge flow rate (i. e. capacity).

In other words, the said second control valve 9 will act to control the discharge flow rate (the capacity) per rotation of the said variable hydraulic pump 1 so that a differential pressure between the pump discharge pressure $P_1$ and the load pressure may be constant, thus a pump discharge flow rate in agreement with a required flow rate of the above mentioned operating valve 3 may be obtained.

By the way, if such a capacity control apparatus is adopted, however, it may be noted that since the operating speed or a rate of response of the said capacity control piston 6*a* varies in accordance with the supply and drain speeds for the pump discharge pressure of the said capacity control cylinder device 6 into and out of the said large diameter chamber 7 (i. e. the pressure changing rate within the said large diameter chamber 7 of the capacity control cylinder device 6), the response will be quick in rate when the self discharge pressure $P_1$ is high since the rates at which the pump discharge pressure is supplied and drained are then high, and it will be slow in rate when the self discharge pressure $P_1$ is low since the rates at which the pump discharge pressure is supplied and drained are then low.

For this reason, if the response rate encountered when the self discharge pressure is low is adjusted to be a satisfactorily quick rate, it would follow that the response rate encountered when the self discharge pressure is high should be excessively quick,. possibly resulting in the damage of a component in the hydraulic pump, e. g. the fact that the swash plate upon colliding with a stopper may be damaged. It may also be noted that a temporary sudden drop in the suction pressure accompanying an abrupt increase in the capacity should create a cavitation. It may further be noted that when the working machine load is large and yet the load pressure $P_o$ is high (i. e. when the self discharge pressure is high), the working machine in operation could be excessively accelerated, bringing about a vibration (or flattering) of the working machine as well as a shock on and a swing of the vehicle body.

Then, in order to resolve these problems, there has been proposed, as disclosed, e. g., in Japanese Unexamined Utility Model Publication No. Hei 4-137285, a capacity control apparatus for a variable capacity hydraulic pump in which a variable throttle valve is provided in a circuit connected to a said large capacity chamber 7 of a said capacity control cylinder device 6 as shown in FIG. 1 of the accompanying drawings hereof such that when the self discharge pressure is low it may have a greater area of aperture throttled and when the self discharge pressure is high it may have a reduced area of aperture throttled.

If such a capacity control apparatus is adopted, it can be seen that when the self discharge pressure of a variable capacity hydraulic pump is low the said variable throttle valve will have an increased area of aperture throttled to allow the said self discharge pressure to be smoothly applied into the said large diameter chamber 7 of the said capacity control cylinder device 6 whereas when the self discharge pressure is high the said variable throttle valve will have a reduced area of aperture throttled to limit an application of the said self discharge pressure into the pressure receiving chamber. It can thus be seen that this arrangement is capable of preventing the rate of response for the capacity control from becoming excessively rapid.

With such a capacity control apparatus, however, it is not possible to establish a rate of response for the capacity control as desired, since it has to be determined by both a self discharge pressure and a throttled area of aperture of the variable throttle valve.

On the other hand, it should be noted that a hydraulic shovel may entail a ramming operation for a ground by using a bucket and may also involve a screening-down operation and so forth by using a perforated bucket. In any of these operations, a quick rate of response is required since a bucket has to be handled at an increased speed. In a high-precision excavating operation (or a high-precision plowing operation) for a ground with a bucket and a tube suspending operation, a relatively slow rate of response is required since the bucket has to be operated slowly.

In this manner, in the case of a hydraulic shovel, a different rate of response is required depending upon a particular working specification and also depending upon a particular degree of the operator's skill and its favor. It must be noted, however, that this requirement may not necessarily be satisfied using a capacity control apparatus as mentioned in the foregoing.

Also, in a capacity control apparatus as mentioned in the foregoing in which a flow of the pressure fluid into the said large diameter chamber 7 of the said capacity control cylinder device 6 is limited by passing it through a throttled area of aperture of the said variable throttle valve to control the rate of operation of the said capacity control cylinder device 6, thereby controlling the rate of response, it can be seen that the resulting rate of response is approximately in inverse proportion to the self discharge pressure. It is accordingly not possible to much slow down the rate of response when the self discharge pressure is high, compared with the rate of response where the self discharge pressure is low.

For this reason, it is possible, with a previously mentioned capacity control apparatus, that the occurrence of a possible damage of a component interior of a hydraulic pump and the generation of a cavitation, may not be prevented with certainty. Both this possible damage and the cavitation can occur because the rate of response to increase the capacity can become excessive, when the self-discharge pressure is high.

Accordingly, with the above mentioned problems taken into account, it is an object of the present invention to provide a capacity control apparatus for a variable capacity hydraulic pump whereby it is possible to prevent the rate of response for capacity control from becoming excessively rapid when an elevated self discharge pressure is encountered and it is yet possible to render the rate of response as desired in agreement with a particular working specification as well as a particular degree of the operator's skill and its favor.

SUMMARY OF THE INVENTION

In order to achieve the object mentioned above, there is provided in accordance with the present invention, in a first general form thereof, a capacity control apparatus for a variable capacity hydraulic pump comprises:

a capacity control cylinder having a capacity control piston for driving a capacity control member of the variable capacity hydraulic pump, and a large diameter chamber and a small diameter chamber which are disposed at both sides of the said capacity control piston, respectively, and driving the said capacity control piston with a pressure fluid that is supplied into the said larger diameter chamber, in a direction in which the capacity of the said variable capacity hydraulic pump may be reduced and for driving the said capacity control piston with a pressure fluid that is supplied into the said small diameter chamber, in a direction in which the said capacity may be increased;

a passage in which the said small diameter chamber is allowed to communicate with a pump discharge path;

at least one control valve for controlling the capacity of the said variable capacity hydraulic pump by permitting the said large diameter chamber to selectively communicate with one of a pump pressure discharge path and a reservoir; and a variable throttle valve that is provided in a passage in which the said large diameter chamber is allowed to selectively communicate with one of the said pump pressure discharge path and the said reservoir, in which the said variable throttle valve is capable of being switched into a first state in which a throttled area of aperture that is in inverse proportion to a self discharge pressure of the said pump discharge path is established and into a second state in which a predetermined throttled area of aperture that is independent of said self discharge pressure is established in response to an external signal.

According to the construction mentioned above, it can be seen that when a low self discharge pressure is issued from the said variable capacity hydraulic pump, the throttled area of aperture of the said variable throttle valve will be enlarged to ensure the smoothness of the pressure fluid flowing into and out of the said large diameter chamber of the capacity control cylinder device and when a high self discharge pressure is issued from the said variable capacity hydraulic pump, the throttled area of aperture of the said variable throttle valve will be reduced to limit the pressure fluid flowing into and out of the said large diameter chamber. Accordingly, when the self discharge pressure is high, it is possible to prevent the rate of response for capacity control from becoming excessively rapid. Also, since the rate of response for capacity control can be established by an external signal so as to be a predetermined rate that is independent of the self discharge pressure, it is yet possible to establish a rate of response as desired in agreement with a particular working specification as well as a particular degree of the operator's skill and its favor.

The invention also provides, in a second general form thereof, a capacity control apparatus for a variable capacity hydraulic pump comprises:

a capacity control cylinder having a capacity control piston for driving a capacity control member of the variable capacity hydraulic pump, and a large diameter chamber and a small diameter chamber which are disposed at both sides of said capacity control piston, respectively, and driving the said capacity control piston with a pressure fluid that is supplied into the said larger diameter chamber, in a direction in which the capacity of the said variable capacity hydraulic pump may be reduced and for driving the said capacity control piston with a pressure fluid that is supplied into the said small diameter chamber, in a direction in which the said capacity may be increased;

a passage in which the said small diameter chamber is allowed to communicate with a pump discharge path;

at least one control valve for controlling the capacity of the said variable capacity hydraulic pump by permitting the said large diameter chamber to selectively communicate with one of a pump pressure discharge path and a reservoir;

a throttle that is provided in a fluid passage for draining into the said reservoir a pressure fluid that is drained from the said large diameter chamber; and an auxiliary pressure receiving portion which is provided in the said at least one control valve and into which a pressure at the upstream side of the said throttle is introduced and that is adapted to thrust the said at least one control valve under the said upstream side pressure in a direction in which the said pump discharge path is allowed to communicate with the said large diameter chamber.

According to the construction mentioned above, it can be seen that when the said capacity control piston is moved in a direction in which the said capacity is increased, the higher the self discharge pressure the greater will the area of aperture be reduced of the passage of the said at least one control valve for draining the pressure fluid out of the said large diameter chamber of the capacity control cylinder device. Accordingly, if the rate of response when the self discharge pressure is low is somewhat accelerated in a direction in which the said capacity is increased, it can be seen that the rate of response when the self discharge pressure is high may not much be accelerated in a direction in which the said capacity is increased. Therefore, any damage of a component interior of the said hydraulic pump and any generation of a cavitation therein can be prevented without fail.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but rather to facilitate an explanation and understanding thereof.

In the accompanying drawings.

BEST MODES FOR CARRYING OUT THE INVENTION

Figure 1:
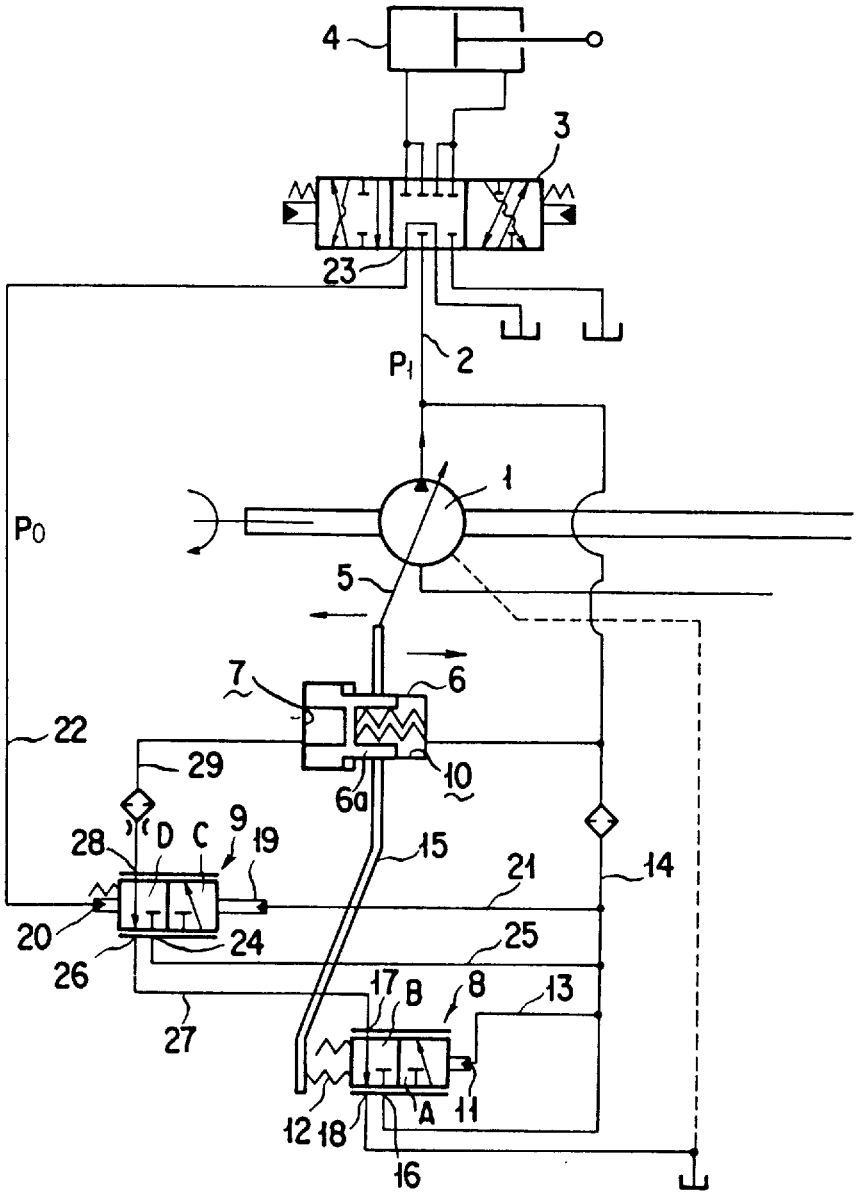
FIG. 1 PRIOR ART
FIG. 1 is a constructive explanatory view of a capacity control apparatus for a variable capacity hydraulic pump in the prior art.

Hereinafter, suitable embodiments of the present invention with respect to a capacity control apparatus for a variable capacity hydraulic pump will be set forth with reference to the accompanying drawings hereof.

An explanation will now be given of a first embodiment of the capacity control apparatus according to the present invention with reference to FIG. 2. In this connection it should be noted that the same components as in the prior art previously set forth are designated by the same reference numerals and their detailed explanation will be omitted.

As shown, there is provided a variable throttle valve 30 in a sixth fluid passage 29 in which the large diameter chamber 7 of the said capacity control cylinder 6 and the second port 28 of the said second control valve 9 are allowed to communicate with each other.

Figure 3:
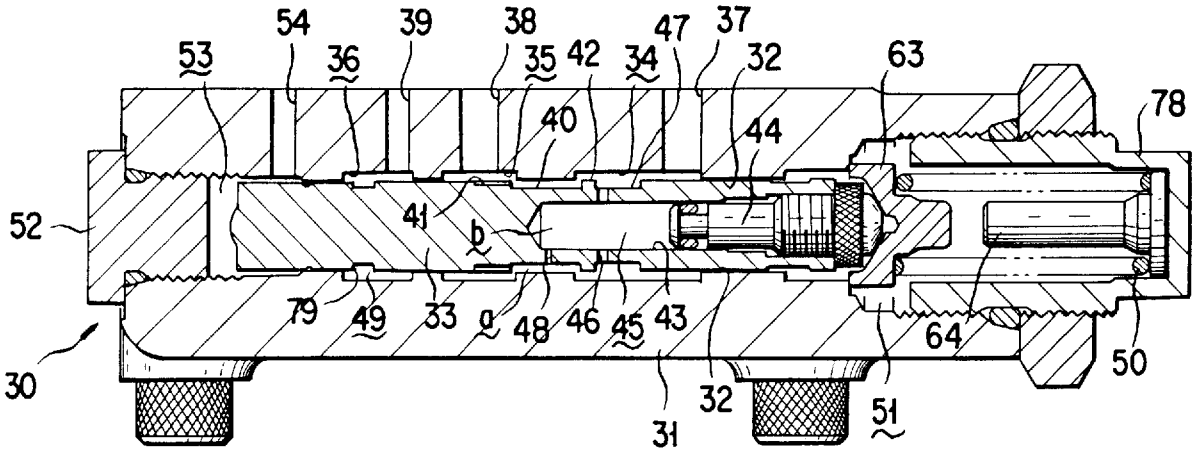
FIG. 3 is a cross sectional view illustrating an exemplary variable throttle valve in the above mentioned first embodiment, the valve being in a state in which the throttled area of aperture is enlarged.

As shown in FIG. 3, the above mentioned variable throttle valve 30 has a valve body 31 formed with a spool bore 32 to which are opened a first port 37, a second port 38 and a third port 39. A spool 33 is fittedly inserted in the said spool bore 32 so as to be slidably displaced therein. Between the said spool bore 32 and the said spool 33 there are formed a first annular space 34, a second annular space 35 and a third annular space 36. The said valve body 31 is so designed that the said first space 34 may communicate with a first port 37, the said space 35 may communicate with a second port 38, the said third space 36 may communicate with a third port 39, the said first port 37 may communicate with the large diameter chamber 7 of the said capacity control piston 6, the second port 38 may communicate with the second port 28 of the said second control valve 9, and the said third port 39 may communicate with the said pump pressure introduction passage 14.

The said valve body 31 is further designed so that the first space 34 and the second space 35 mentioned above may communicate with each other only via a first small diameter section 40 of the said spool 33 when the latter takes the position shown; if the said spool 33 is slidably displaced rightwards by a predetermined distance they may communicate with each other via the said first small diameter section 40 of the spool 33 and a slit groove 41 (functioning as a throttle) formed on the peripheral surface of the said spool 33; and if the said spool 33 is slidably displaced leftwards by a predetermined distance, a large diameter section 42 thereof may be fitted in the said spool bore 32 to block a communication between the said first space 34 and the said second space 35. Thus, the communication between the said first space 34 and the said second space 35 is selectively established and blocked thereby and there is constituted a main path of communication a with a variably throttled area of aperture.

An axial bore 43 is formed axially of the above mentioned spool 33 and has at its right hand side end a plug 44 inserted and fixed therein while there is formed a spatial section 45 between the inner surface of the said axial bore 43 of the left hand side end of the said plug 44. The said spatial section 45 is designed to communicate with the said first space 34 via a first fine bore 46 and a second small diameter section 47 of the said spool 33 and also to communicate with the said first small diameter section 40 of the spool 33 via a second fine bore 48, thus constituting an auxiliary path of communication b with a predetermined throttled area of aperture in which the said first space 34 and the said second space 35 are allowed to communicate with each other.

The portion of the above mentioned spool 33 which confronts the said third space 36 is formed with an annular recess 79, across which the said spool 33 is large in diameter on the right hand side and is small in diameter on the left hand side and where there is constituted a pressure receiving portion 49 that is adapted to thrust the said spool 33 rightwards. Thus, the said spool 33 is arranged to be thrusted rightwards or in a direction in which the throttled area of aperture of the above mentioned main path of communication a is reduced, under a self discharge pressure that is supplied to the said pressure receiving portion 49.

Also, the above mentioned spool 33 is arranged to be thrusted leftwards or in a direction in which the throttled area of aperture of the above mentioned main path of communication a is enlarged, by both a spring 50 is received within a spring cylinder 78 threadedly attached to the right hand side end of the said spool bore 32 and is in contact via a spring bearing 63 to the right hand side end of the said plug 44 and a pressure fluid within a pressure receiving chamber 51 formed at the right hand side end of the said spool 33.

Further, a plug 52 is threadedly attached to the left hand side end of the said spool bore 32 and a space 53 is formed by the left end face of the above mentioned spool 33, a plug 52 and the said spool bore 32. The said space 53 is arranged to communicate with a reservoir 56 via a tank port 54 and so that the said spool 33 may be slidably displaced both leftwards and rightwards by an axial length of the said space.

Figure 2:
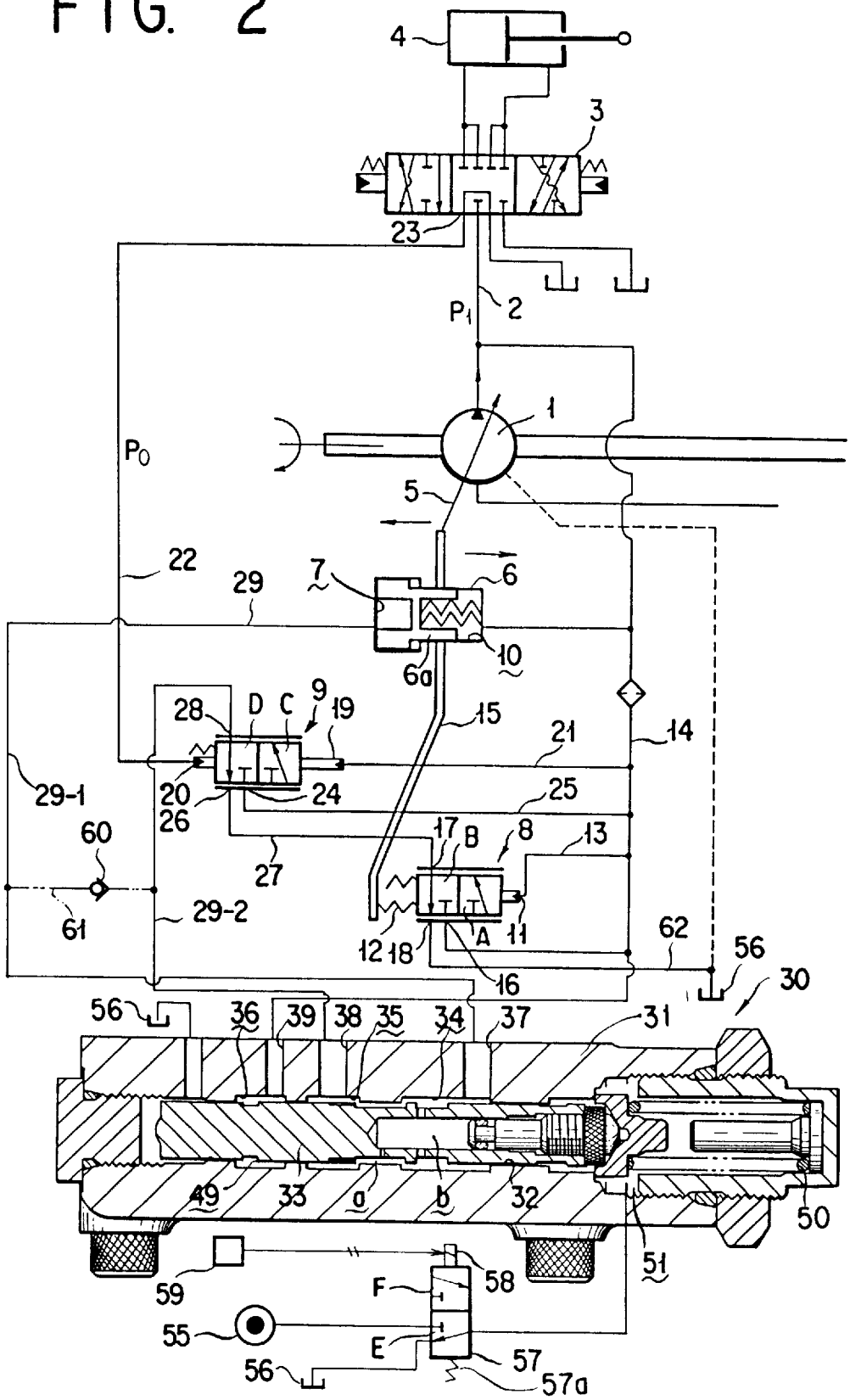
FIG. 2 a constructive explanatory view of a first embodiment of the capacity control apparatus for a variable capacity hydraulic pump, according to the present invention.

As shown in FIG. 2, note also that the above mentioned pressure receiving chamber 51 is arranged to communicate with one of a fluid pressure source 55 and the said reservoir 56 via a switching valve 57.

The said switching valve 57 is held by a spring 57*a* to assume a drain position E and, with a solenoid 58 electrically energized, is switched to assume a supply position F. The said solenoid 58 is adapted to be brought into an energized and a non-energized state by acting on an operating means 59.

An explanation will now be given with respect to an operation of the said variable throttle valve 30.

When the said switching valve 57 assumes the said drain position E with the said solenoid in a non-energized state, the said pressure receiving chamber 51 will communicate with the said reservoir 56. Then, the said spool 33 may be slidably displaced either leftwards or rightwards by a difference between the self discharge pressure acting on the said pressure receiving portion 49 and the energizing force by the said spring 50.

This will cause the said spool 33 to be displaced leftwards as shown in FIG. 3, when the self discharge pressure is low, to allow the said first space 34 and the said second space 35 to communicate with each other via the said first small diameter section 40. Then, the throttled area of aperture of the said main path of communication a will be enlarged.

Figure 4:
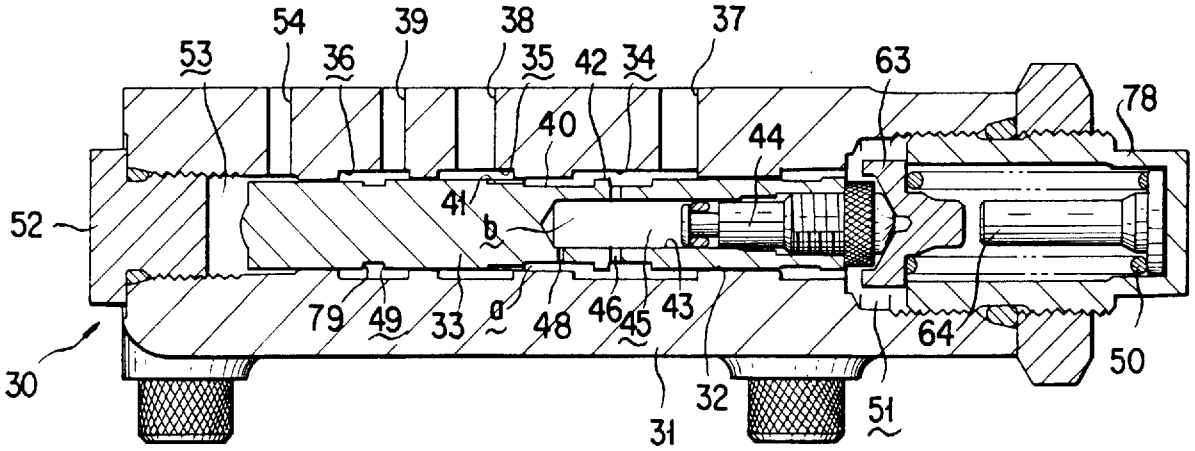
FIG. 4 is a cross sectional view illustrating the above mentioned exemplary variable throttle valve, the valve being in a state in which the throttled area of aperture is reduced.

Also, when the self discharge pressure is high, the said spool 33 will be slidably displaced, as shown in FIG. 4, to allow the said first space 34 and the said second space 35 to communicate with each other via the said first small diameter section 40 and the said slit 41. Then, the throttled area of aperture of the said main path of communication a will be reduced.

In this manner, it can be seen that the throttled area of aperture of the said variable throttle valve 30 will be large when the self discharge pressure is low and will be small when the self discharge pressure is high. Accordingly, the higher the self discharge pressure, the greater will the pressure fluid flowing into and flowing out of the said large diameter chamber 7 of the capacity control cylinder 6 be limited. Thus, the rate of response will be slowed down as the self discharge pressure is elevated.

Figure 5:
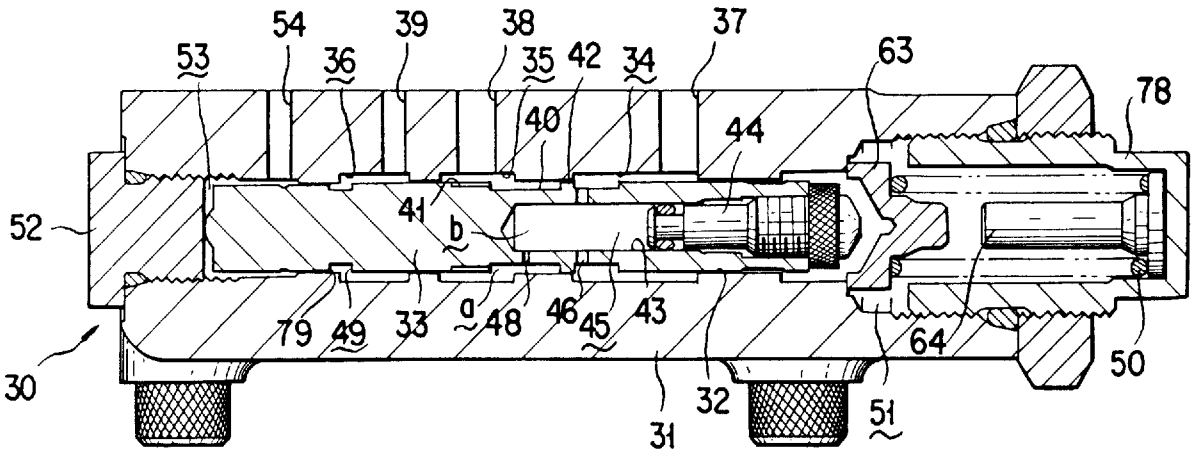
FIG. 5 is a cross sectional view illustrating the above mentioned exemplary variable throttle valve, the valve being in a state in which the throttled area of aperture is of a predetermined value.

Also, if the said solenoid 58 is electrically energized by operating the said operating means 59, the said switching valve 57 will be switched to assume the said supply position F to allow the pressure fluid from the fluid pressure source 55 to be supplied into the said pressure receiving chamber 51. Then, the said spool 33 will be thrusted leftwards until it makes a contact with the said plug 52, as shown in FIG. 5.

This will cause the said main path of communication a to be blocked with the said first large diameter section 42 to allow the said first space 34 and the said second space 35 to communicate with each other then via the said auxiliary path of communication b.

Accordingly, operating the operation member 59 will allow the throttled area of aperture of the said variable throttle valve 30 to be set at a value that is determined by the said first fine bore 46 or the second fine bore 48 and hence will allow the rate of response to be preset as desired.

In the arrangement in FIG. 2, it should be noted that a first fluid passage 29-1 in which the said sixth fluid passage 29 is connected to the said first port 37 and a second fluid passage 29-2 in which it is connected to the said second port 38 may be provided and connected to each other with a bypass passage 61.

By so doing, it can be seen that since the pressure fluid from the second port 28 of the said second control valve 9 is allowed to flow directly into the said large diameter chamber 7 of the capacity control cylinder 6 via the said bypass passage 61, it is possible to enhance the responsiveness when the capacity is to be reduced.

It should be noted that the above mentioned variable throttle valve 30 may also be provided in any of the said fourth fluid passage 25, the said fifth fluid passage 27 and a drain fluid passage 62 in which the said drain port 18 of the first control valve 8 is allowed to communicate with the said reservoir 56 in the arrangement of FIG. 2.

Figure 6:
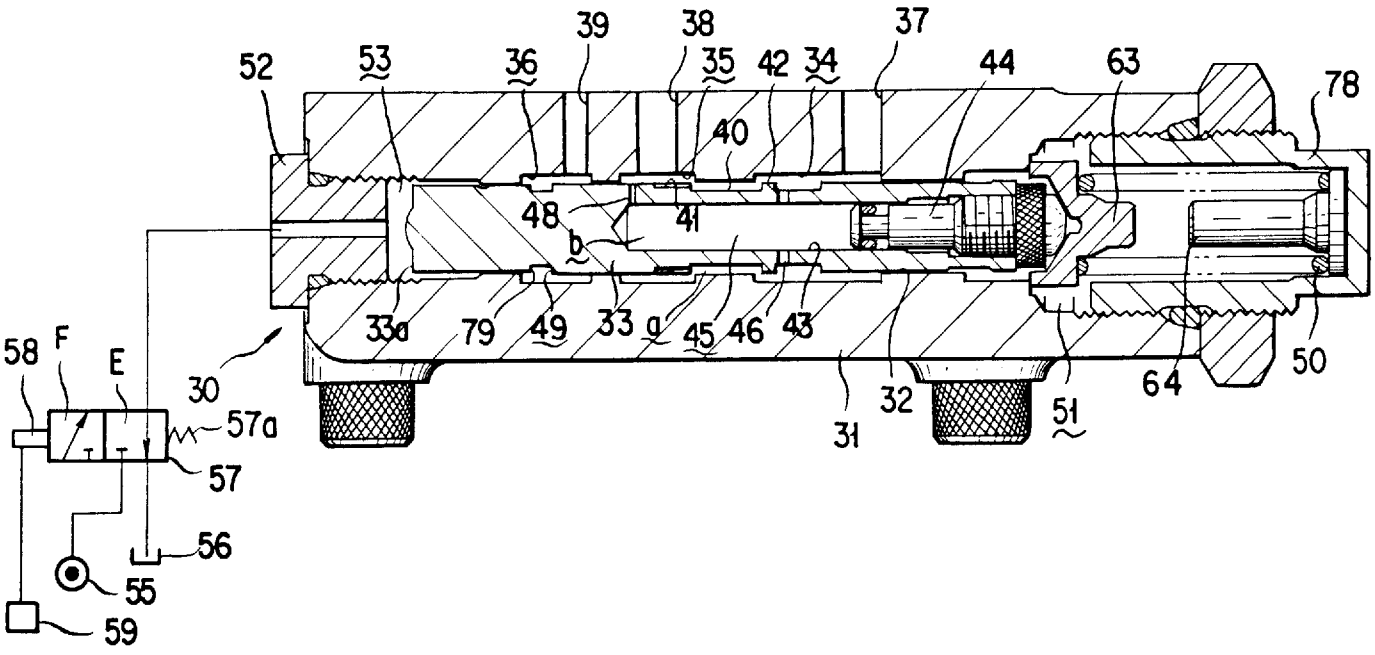
FIG. 6 is a cross sectional view of another exemplary variable throttle valve in the above mentioned first embodiment of the present invention.

FIG. 6 shows a second embodiment of the variable throttle valve 30, in which a said spatial section 45 of the spool 33 is designed to communicate with a said second port 38 via a said second fine bore 48, at the left hand side to a said slit 41 in the said spool 33 and in which a said space 53 is connected to one of a said reservoir 56 and a said fluid pressure source 55 with a said switching valve 57.

With such an arrangement adopted, it can be seen that if the switching valve 57 is switched to assume a said supply position F to supply the said space 53 with a pressure fluid from the said fluid pressure source 55, the pressure fluid acting on a left end surface 33*a* of the spool 33 will cause the said spool 33 to be displaced rightwards until a spring bearing 63 is brought into contact with a stopper 64 that is provided in a spring cylinder 78. Since this causes the said slit 41 to be closed to close a said main path of communication a and to allow a said first space 34 and a said second space 35 to communicate with each other via a said auxiliary path of communication b, it is possible that the throttled area of aperture may become a value that is determined by a said first fine bore 46 and the said second fine bore 48 as in the previous embodiment.

As described above, according to the foregoing first embodiment of the present invention, it can be seen that since when the self discharge pressure is elevated it is possible to prevent the rate of response for capacity control from becoming excessively rapid and it is further possible to set the rate of response for capacity control to be a predetermined rate of response that is independent of the self discharge pressure, it become possible to establish a rate of response as desired that is in agreement with a particular working specification as well as a particular degree of the operator's skill and its favor.

Figure 7:
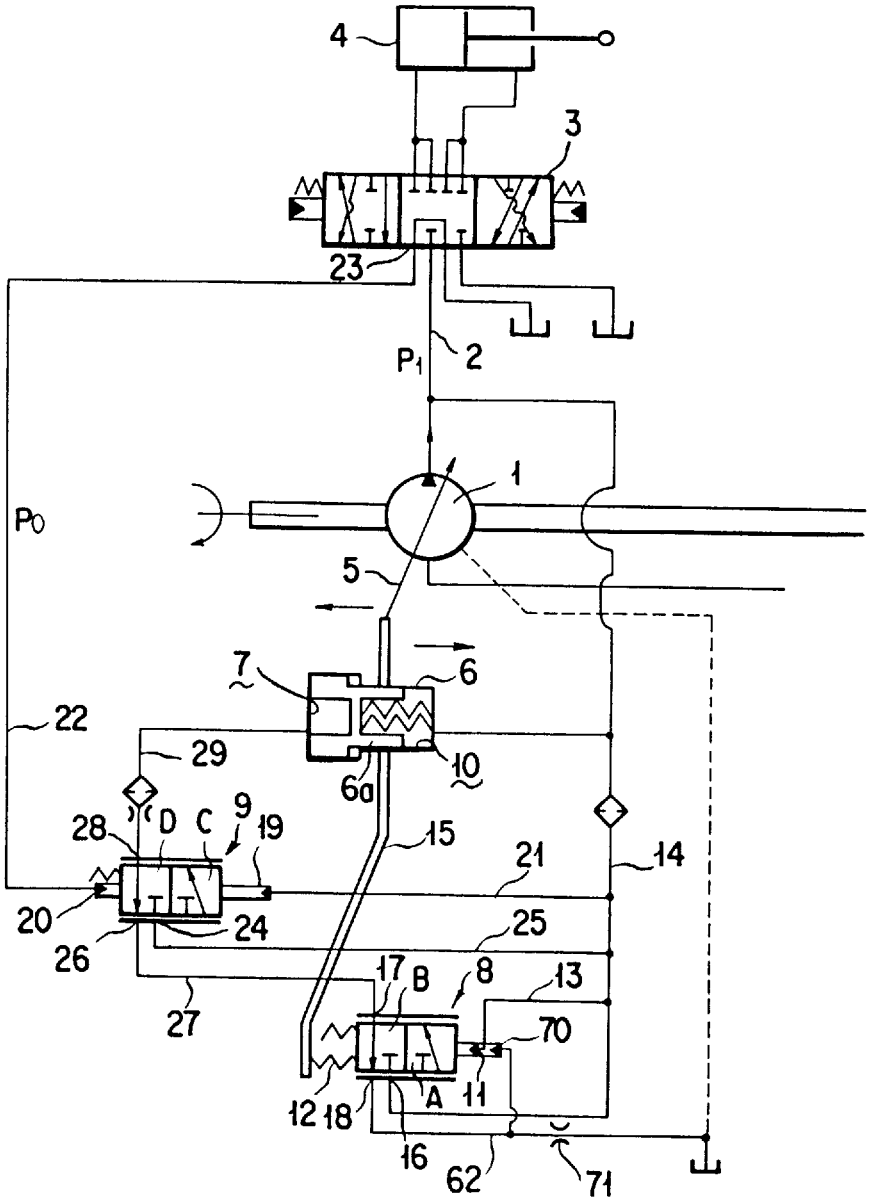
FIG. 7 is a constructive explanatory view of a second embodiment of the capacity control apparatus for a variable capacity hydraulic pump, according to the present invention.

An explanation will next be given with respect to a second embodiment of the capacity control apparatus according to the present invention with reference to FIG. 7.

Here, the said first control valve 8 is provided with an auxiliary pressure receiving section 70 that is adapted to thrust the said first control valve 8 to the said supply position A and the section 70 is connected to an above mentioned drain fluid passage 62 where there is provided a throttle 71 so that a pressure upstream thereof may act on the said auxiliary pressure receiving section 70.

If this construction is adopted, it may be seen that a pressure will be generated at the upstream side of the said throttle 71 by a pressure fluid being drained from the large diameter chamber 7 of the said capacity control cylinder device 6 and will act on the said auxiliary pressure receiving section 70 so as to cause the said first control valve 8 to be thrusted towards the said supply position A. And, it should be noted that the pressure at the upstream side of the above mentioned throttle 71 will become a pressure that is proportional to the square of a flow velocity of the said pressure fluid being drained, which flow velocity is proportional to the velocity at which the said capacity control piston 6*a* is slidably displaced in a direction in which the said capacity is increased.

For this reason, when the said capacity control piston 6*a* is slowly displaced in a direction to increase the capacity as in the case when the self discharge pressure is low, it can be seen that the pressure at the upstream side of the said throttle 71 will be extremely low so that the force with which the said first control valve 8 is thrusted towards the said supply position A may be small and that the area of opening between the said outlet port 17 and the said drain port 18 of the first control valve 8 may be made substantially equal to a case in which the said auxiliary pressure receiving portion 70 is not present.

Also, when the said capacity control piston 6 is quickly displaced in a direction in which the said capacity is increased as in the case when the self discharge pressure is high, it can be seen that the pressure at the upstream side of the said throttle 71 will be extremely high so that the force with which the said first control valve 8 is thrusted towards the said supply position A may be large and that the area of opening between the said outlet port 17 and the said drain port 18 of the first control valve 8 may be made extremely small compared with a case in which the said auxiliary pressure receiving section 70 is not present.

Accordingly, it can be seen that if the rate of response in a direction in which the said capacity is increased when the self discharge pressure is low is somewhat accelerated, it will be possible that the rate of response when the said self discharge pressure is high may not much be accelerated but may rather be somewhat slowed down then.

Figure 8:
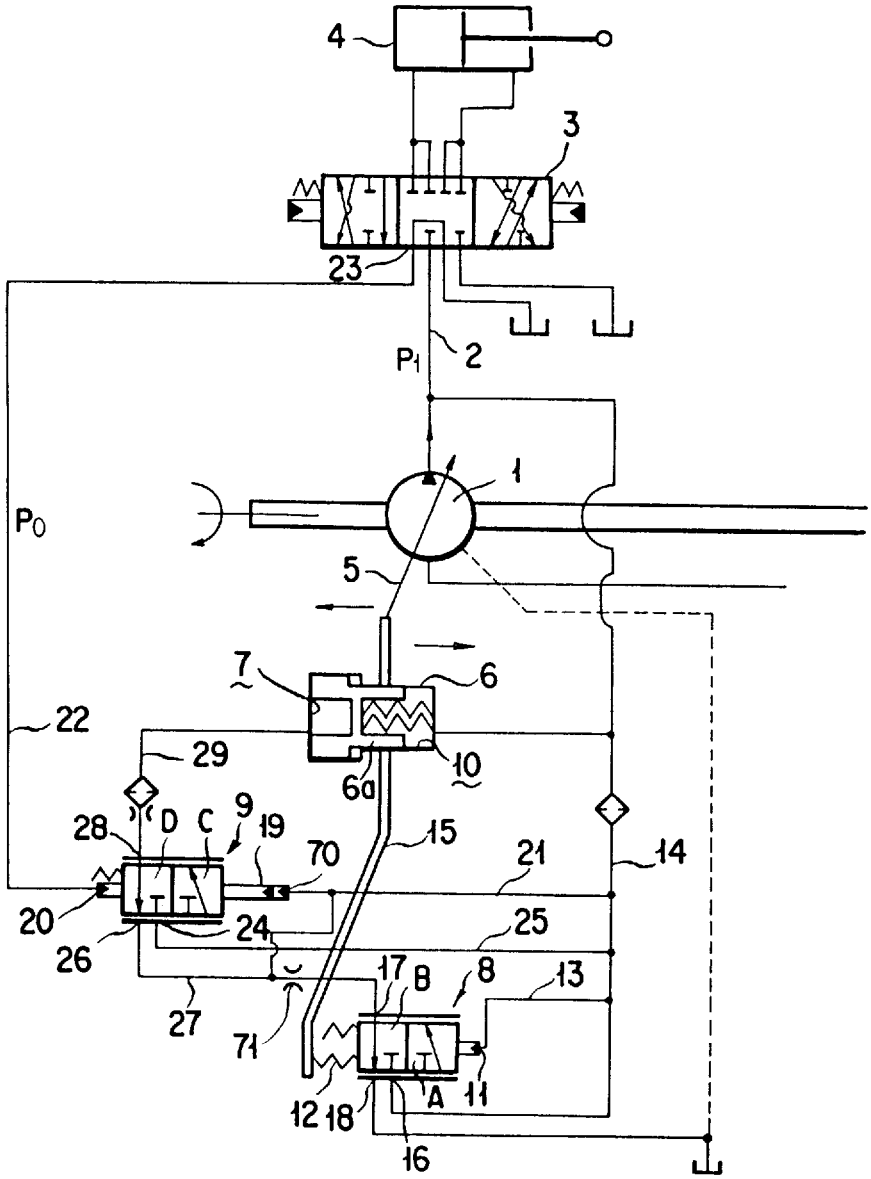
FIG. 8 is a constructive explanatory view of a third embodiment of the capacity control apparatus for a variable capacity hydraulic pump, according to the present invention.

FIG. 8 shows a third embodiment of the capacity control apparatus according to the present invention. Here, the said second control valve 9 is provided with a said auxiliary pressure receiving section 70 with which the said control valve 9 is allowed to be thrusted towards the said supply position C, and the said fifth fluid passage 27 is provided with a said throttle 71 so that a pressure at the upstream side thereof may be delivered to the said auxiliary pressure receiving section 70.

With such an arrangement adopted, it can be seen that since the area of opening between the said first port 26 and the said second port 28 of the second control valve 9 is controlled in a same manner as the area of opening between the outlet port 17 and the drain port 18 of the first control valve 8 as mentioned above in connection with the previously described second embodiment, it will be possible as in the previous case that the rate of response towards increasing the said capacity when the self discharge pressure is high may not much be accelerated but may rather be slowed down then.

Figure 9:
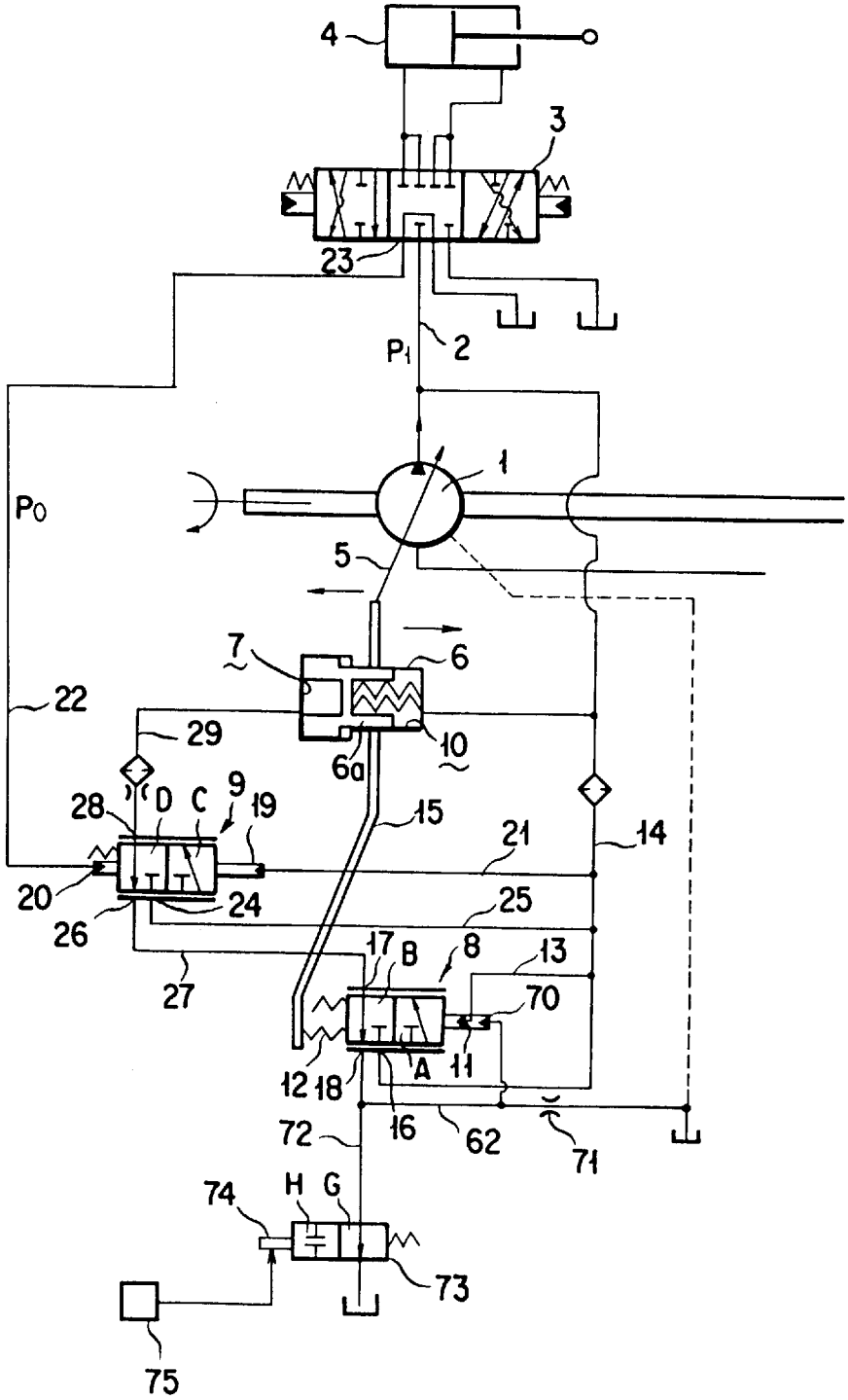
FIG. 9 is a constructive explanatory view of a fourth embodiment of the capacity control apparatus for a variable capacity hydraulic pump, according to the present invention.

FIG. 9 shows a fourth embodiment of the capacity control apparatus according to the present invention. Here, an auxiliary drain fluid passage 72 is provided at the upstream side of the said throttle 71 of the drain fluid passage 62 and is adapted to be closed and opened with a said switching valve 73. And, it should be noted that the above mentioned switching valve 73 is adapted to normally assumes a position of communication G and, with a solenoid 74 electrically energized by an operating means 75, to be switched to assume a blocking position H.

With such an arrangement adopted, it can be seen that since a pressure is not created at the upstream side of the said throttle 71 if the switching valve 73 assumes the said position of communication G, the said first control valve 8 will be controlled as in the case in which the said auxiliary pressure receiving section 70 is not present, so that the rate of response may be a predetermined rate. If the said switching valve 73 is switched to assume the said blocking position H, it follows that the rate of response can be controlled towards increasing the said capacity in a same principle as in the previously mentioned second embodiment.

Figure 10:
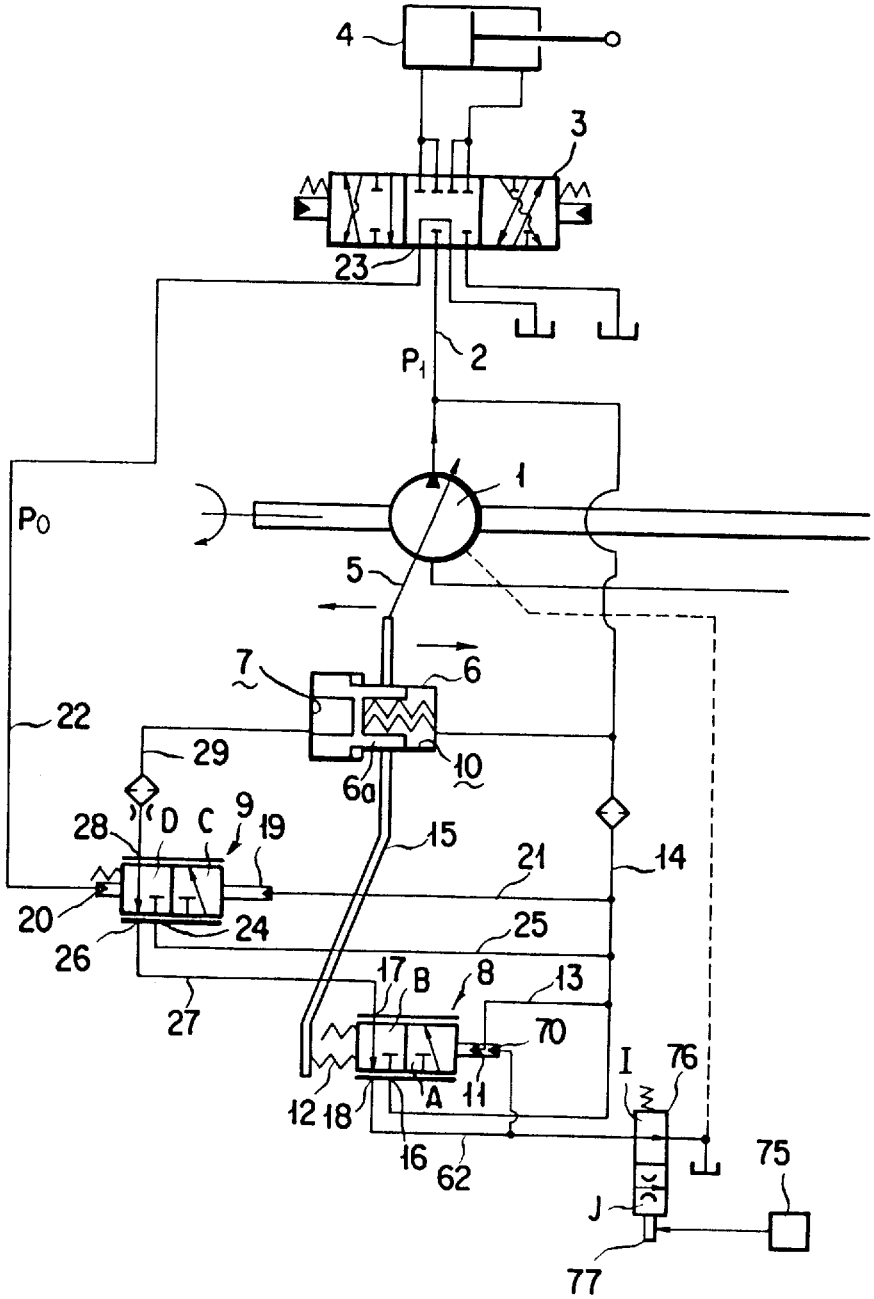
FIG. 10 is a constructive explanatory view of a fifth embodiment of the capacity control apparatus for a variable capacity hydraulic pump, according to the present invention.

FIG. 10 shows a fifth embodiment of the capacity control apparatus according to the present invention. Here, a said drain fluid passage 62 is provided with a switching valve 76 that is designed to normally assume a position of communication I and, with a solenoid 77 electrically energized by the said operating means 75, to be switched to assume a position of throttle communication J.

With such an arrangement adopted, it can be seen that when the said switching valve 76 is switched to assume the said position of communication I, the rate of response will be controlled as in the case in which the said auxiliary pressure receiving section 70 is not provided and that when the said position of throttle communication J is taken, the rate of response will be controlled towards increasing the said capacity in a same principle as in the previously mentioned second embodiment.

As will be apparent from the foregoing description, according to the second to fifth embodiments of the present invention, it will be appreciated that when the said capacity control piston 6*a* is moved in a direction in which the said capacity is increased, the greater the self discharge pressure, the more will the area of opening of the passage through which the pressure fluid is drained from the said large diameter piston 7 of the capacity control cylinder device 6 of the said first control valve 8 or the said second control valve 9 be throttled. Accordingly, it can be seen that if the rate of response in a direction in which the said capacity may be increased when the self discharge pressure is low is somewhat made quicker, it will be possible that the rate of response in a direction in which the said capacity should be increased when the self discharge pressure is high may not much be accelerated. Hence, both the occurrence of any damage of a component interior of the hydraulic pump and the generation of a cavitation therein can be prevented without fail.

While the present invention has hereinbefore been described with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. A capacity control apparatus for a variable capacity hydraulic pump having a capacity control member driveable in a first direction for increasing capacity of said hydraulic pump and in a second direction for reducing capacity of said hydraulic pump, said apparatus comprising:

a capacity control cylinder having a capacity control piston connected for driving the capacity control member of the variable capacity hydraulic pump, and a large diameter chamber and a small diameter chamber which are disposed at both sides of said capacity control piston, respectively, said larger diameter chamber being connected such that when a pressure fluid is supplied into said large diameter chamber, said piston is driven in said second direction and said small diameter chamber being connected such that when a pressure fluid is supplied into said small diameter chamber, said piston is driven in said first direction;

a passage in which said small diameter chamber is allowed to communicate with a pump discharge path;

at least one control valve for selectively communicating said large diameter chamber with one of a pump pressure discharge path and a reservoir; and a variable throttle valve provided in a passage in which said large diameter chamber is allowed to selectively communicate with one of said pump pressure discharge path and said reservoir, said variable throttle valve being switched into a first state in which a throttled area of aperture that is in inverse proportion to a self discharge pressure of said pump discharge path is established and into a second state in which a predetermined throttled area of aperture that is independent of said self discharge pressure is established in response to an external signal.

2. A capacity control apparatus for a variable capacity hydraulic pump as set forth in claim 1 in which said at least one control valve is operatively associated with said capacity control piston and is driven by self discharge pressure of said pump discharge path so as to maintain a driving torque of said variable capacity hydraulic pump constant.

3. A capacity control apparatus for a variable capacity hydraulic pump as set forth in claim 1 in which said at least one control valve is driven by both the self discharge pressure of said pump discharge path and a load pressure of an actuator so as to maintain a differential pressure between said self discharge pressure and said load pressure constant.

4. A control apparatus for a variable capacity hydraulic pump as set forth in claim 1 in which said at least one control valve comprises:

a first control valve operatively associated with said capacity control piston and is driven by the self discharge pressure of said pump discharge path so as to maintain a driving torque of said variable capacity hydraulic pump constant; and a second control valve driven by both the self discharge pressure of said pump discharge path and a load pressure of an actuator so as to maintain a differential pressure between said self discharge pressure and said load pressure constant.

5. A capacity control apparatus for a variable capacity hydraulic pump as set forth in any one of claims 1 to 4 in which said variable throttle valve comprises:

a valve body;

a spool fittedly inserted in a spool bore that is formed in said valve body;

a main path of communication having a first throttled area of aperture which is increased and decreased as said spool is displaced in different directions and which is blocked when said spool has been displaced by a predetermined distance;

an auxiliary path of communication having a predetermined second throttled area of aperture and which establishes a communication when said spool has been displaced by a predetermined distance;

a pressure receiving portion in said valve body into which said self discharge pressure is introduced, said spool being urged under said self discharge pressure in one of said different directions in which the first throttled area of aperture is reduced;

a spring that is adapted to thrust said spool in the other of said different directions; and a spool driving means responsive to an external signal for displacing said spool by a predetermined distance.

6. A capacity control apparatus for a variable capacity hydraulic pump as set forth in claim 5 in which said spool driving means comprises:

a pressure receiving chamber provided at one side of said spool; and a switching valve for permitting said pressure receiving chamber to be selectively connected with one of a fluid pressure source and a reservoir.

7. A capacity control apparatus for a variable capacity hydraulic pump having a capacity control member driveable in a first direction for increasing capacity of said hydraulic pump and in a second direction for reducing capacity of said hydraulic pump, said apparatus comprising:

a capacity control cylinder having a capacity control piston connected for driving the capacity control member of the variable capacity hydraulic pump, and a large diameter chamber and a small diameter chamber which are disposed at both sides of said capacity control piston, respectively, said larger diameter chamber being connected such that when a pressure fluid is supplied into said large diameter chamber, said piston is driven in said second direction and said small diameter chamber being connected such that when a pressure fluid is supplied into said small diameter chamber, said piston is driven in said first direction;

a passage in which said small diameter chamber is allowed to communicate with a pump discharge path;

at least one control valve for controlling the capacity of said variable capacity hydraulic pump by permitting said large diameter chamber to selectively communicate with one of a pump pressure discharge path and a reservoir;

a throttle provided in a fluid passage for draining into said reservoir said pressure fluid that is drained from said large diameter chamber; and an auxiliary pressure receiving portion which is provided in said at least one control valve and into which a pressure at the upstream side of said throttle is introduced and urges said at least one control valve under said upstream side pressure in a direction in which said pump discharge path is allowed to communicate with said large diameter chamber.

8. A capacity control apparatus for a variable capacity hydraulic pump as set forth in claim 7 in which said at least one control valve is operatively associated with said capacity control piston and is driven by the self discharge pressure of said pump discharge path so as to maintain a driving torque of said variable capacity hydraulic pump constant.

9. A capacity control apparatus for a variable capacity hydraulic pump as set forth in claim 7 in which said at least one control valve is driven by both the self discharge pressure of said pump discharge path and a load pressure of an actuator so as to maintain a differential pressure between said self discharge pressure and said load pressure constant.

10. A capacity control apparatus for a variable capacity hydraulic pump as set forth in claim 7 in which said at least one control valve comprises:

a first control valve operatively associated with said capacity control piston and is driven by the self discharge pressure of said pump discharge path so as to maintain a driving torque of said variable capacity hydraulic pump constant; and a second control valve driven by both the self discharge pressure of said pump discharge path and a load pressure of an actuator so as to maintain a differential pressure between said self discharge pressure and said load pressure constant.

11. A capacity control apparatus for a variable capacity hydraulic pump as set forth in any one of claims 7 to 10 further comprising means for switching said throttle in response to an external signal into a first state in which a pressure fluid is allowed to flow therethrough and into a second state in which the pressure fluid is not allowed to flow therethrough.

12. A capacity control apparatus for a variable capacity hydraulic pump as set forth in claim 11 in which an auxiliary drain passage is connected to the upstream side of said throttle and said means for switching comprises a switching valve in said auxiliary drain passage that is closed and opened in response to said external signal.

13. A capacity control apparatus for a variable capacity hydraulic pump as set forth in claim 11 in which said means for switching includes a switching valve which comprises said throttle and a passage of communication, said switching valve being disposed in a fluid passage for draining said pressure fluid into a reservoir from said large diameter chamber; whereby switching is effected between said throttle and said passage of communication in response to an external signal.

* * * * *